US006286690B1

(12) United States Patent
Thalenfeld

(10) Patent No.: US 6,286,690 B1
(45) Date of Patent: Sep. 11, 2001

(54) PRODUCT DISPLAY STRIP

(75) Inventor: David R. Thalenfeld, Bear Creek, PA (US)

(73) Assignee: Trion Industries, Inc., Wilkes Barre, PA (US)

( * ) Notice: Subject to any disclaimer, the term of this patent is extended or adjusted under 35 U.S.C. 154(b) by 0 days.

(21) Appl. No.: 09/528,950

(22) Filed: Mar. 21, 2000

(51) Int. Cl.[7] ..... A47F 5/08
(52) U.S. Cl. ..... 211/113; 211/57.1; 211/59.1
(58) Field of Search ..... 211/73, 113, 115–119, 211/57.1, 59.1, 51, 54.1; 206/482, 476, 479, 464, 806

(56) References Cited

U.S. PATENT DOCUMENTS

| | | | | |
|---|---|---|---|---|
| D. 190,608 | | 6/1961 | Forrester | D80/8 |
| D. 202,675 | | 10/1965 | Walker | D80/8 |
| D. 214,107 | | 5/1969 | Hallahan | D6/7 |
| D. 216,008 | | 11/1969 | Dennison | D15/99 |
| D. 318,378 | * | 7/1991 | Baekgaard, Sr. | 211/113 X |
| 1,093,856 | * | 4/1914 | Hurff | 206/482 |
| 1,611,397 | * | 12/1926 | Wells | 211/113 |
| 2,288,706 | | 7/1942 | Herr | 248/215 |
| 2,514,742 | * | 7/1950 | Burger et al. | 211/113 |
| 2,598,492 | * | 5/1952 | Boes | 206/65 |
| 3,420,383 | * | 1/1969 | Raynor | 211/113 |
| 3,592,343 | * | 7/1971 | Swett | 211/113 |
| 3,776,503 | * | 12/1973 | Boden et al. | 211/113 |
| 4,546,943 | * | 10/1985 | Fast | 211/57.1 |
| 4,767,012 | * | 8/1988 | Simmons | 211/113 |
| 4,823,962 | * | 4/1989 | Arias | 211/113 |
| 4,938,368 | * | 7/1990 | Sharman | 211/57.1 |
| 5,096,070 | * | 3/1992 | JAynes | 211/113 |
| 5,199,578 | * | 4/1993 | Perdergraph et al. | 211/113 |
| 5,284,259 | | 2/1994 | Conway et al. | 211/73 |
| 5,344,003 | * | 9/1994 | Park | 206/476 |
| 5,386,916 | * | 2/1995 | Valiulis | 211/113 |
| 5,405,022 | * | 4/1995 | Rissley | 211/59.1 |
| 5,553,721 | * | 9/1996 | Gebka | 211/59.1 |
| 5,649,624 | * | 7/1997 | Seaton | 206/461 |
| 5,683,003 | | 11/1997 | Gebka | 211/57.1 |
| 5,743,403 | * | 4/1998 | Crysdale | 206/482 |
| 5,762,206 | * | 6/1998 | Leichter | 211/113 |
| 5,762,212 | * | 6/1998 | Pomerantz | 211/113 |
| 5,794,800 | * | 8/1998 | Carmo et al. | 211/113 |
| 5,875,901 | * | 3/1999 | Morrow et al. | 211/59.1 |
| 6,006,929 | * | 12/1999 | Leonard | 211/113 |

OTHER PUBLICATIONS

*Buyer's Guide Bulletin,* vol. 3, No. 1. New and Expanded Product Lines: A Primer on Strip Merchandisers“”.4pages.

* cited by examiner

*Primary Examiner*—Jerry Redman
*Assistant Examiner*—Jennifer E. Novosad
(74) *Attorney, Agent, or Firm*—Schweitzer Cornman Gross & Bondell LLP

(57) ABSTRACT

A product display strip is formed of an elongated metal strip, arranged to be suspended in vertical orientation in front of conventional product display shelving, to provide highly visible special product display facing in both directions along a store isle. The strip is formed with integral, product support tongues, extending upward and outward from the body of the strip, alternately in opposite directions, allowing product to be displayed on both sides of the strip. Upper extremities of the product support tongues are oriented generally vertically to inhibit accidental dislodgment of displayed packages.

6 Claims, 3 Drawing Sheets

PRODUCT DISPLAY STRIP

BACKGROUND AND SUMMARY OF THE INVENTION

The present invention relates to product display strips, for the display of packaged and/or individual products with a special, attention-attracting presentation, in conjunction with more convention shelf displays and the like. The invention is directed in particular to specific improvements in such product display strips, to make them more useful and at the same time more economical to manufacture.

Stores of all kinds frequently seek to enhance sales by highlighting new or special products, or products being offered at a special price, for example. Among the many techniques utilized for this purpose are hanging displays, in the form of strips or rods, which can be suspended in the aisle space, in front of the conventional display shelving. One of widely used devices for this purpose is a vertically suspended rod mounting a plurality of package-engaging spring clips. Such devices, while useful for the intended display purposes, are unnecessarily costly because of the cost of the individual clips and the expense of mounting and positioning the clips on the supporting rods. Moreover, the clips frequently are of limited effectiveness for gripping weighty packages, and merchandisers in many cases simply hang heavy packages over the upwardly extending arms of the clips, which are intended to be gripped by the user for opening and closing the clips.

Pursuant to the present invention, an improved display strip is provided which is formed of a relatively stiff, elongated metal strip provided with a plurality of upwardly and outwardly projecting tongues for supporting product packages for display. The product supporting tongues are formed integrally with the metal of the strip, and alternate ones of the tongues project in opposite directions with respect to the principal plane of the strip. The strip is arranged to be suspended from other display facilities of a store, such as racks provided in large chain hardware stores, for example, of from display gondolas commonly used in supermarkets and drug stores. By suspending the strip to have its principal plane perpendicular to the racks, gondolas, etc., from which the strip is suspended, the opposite sides of the strip face up and down the shopping aisles defined in part by the racks, gondolas, etc.

Display arrangements for displaying packages in both directions, up and down shopping aisles, are known in the art, for example Conway et al U.S. Pat. No. 5,284,259, Gebka U.S. Pat. No. 5,683,003 and Forrester U.S. Des. Pat. No. 190,608, but these arrangements are in essence dual strips placed back to back, which tend to be more complicated and less satisfactory than the arrangement of the invention.

In a particularly preferred embodiment of the invention, product supporting tongues are integrally stamped from the body of the display strip, to extend upward and outward at a suitable angle from the plane of the strip, desirably about 35°, alternately in opposite directions. The upper end extremities of the tongues are bent upwardly, to a more vertical orientation, which helps to prevent accidental dislodgment of displayed packages.

For a more complete understanding of the above and other features and advantages of the invention, reference should be made to the following detailed description of a preferred embodiment thereof and to the accompanying drawings.

DESCRIPTION OF PREFERRED EMBODIMENT

Figure 1:
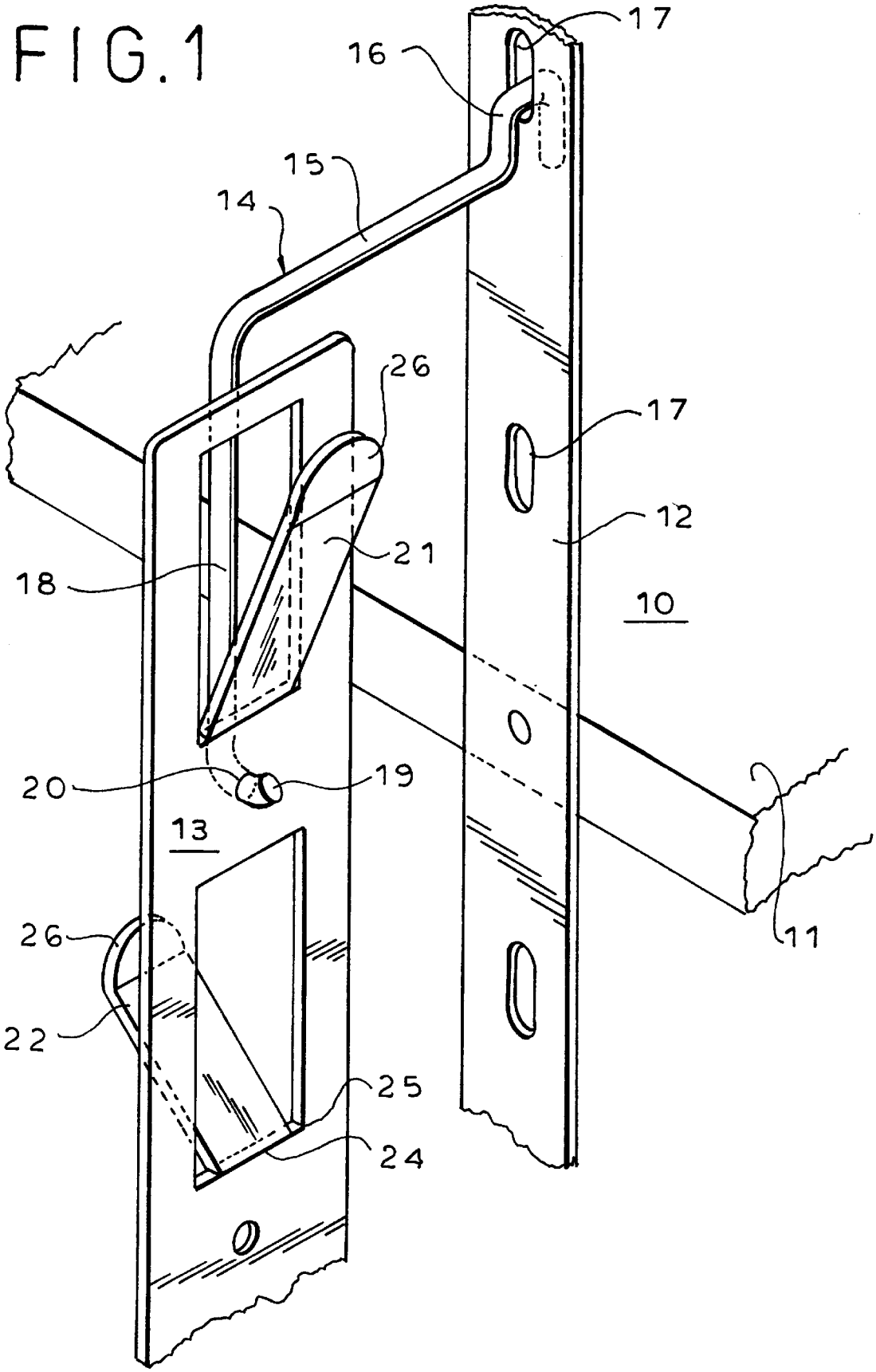
FIG. 1 is an enlarged, fragmentary perspective view of the display strip of the invention, shown mounted at the front of a display rack.

Referring now to the drawing, the reference numeral 10 designates a display rack, such as might be found in a large warehouse type hardware store, for example. The rack includes one or more shelves 11 and vertical supports 12 along the front. Typically, display racks 10 are arranged in spaced apart, opposed pairs, defining elongated shopping aisles which are transitted by customers. In the illustration of FIG. 1, a display strip 13, to be described in more detail, is suspended by means of a wire bracket 14 from the vertical support 12. The bracket 14, which is one of many devices that may be employed to suspend the strip 13, has an upper portion 15 with a hook-shaped end 16 which is received in a slotted opening 17 in the vertical shelf support. A lower portion 18 of the suspension bracket extends downward and is formed with a hook-like lower end 19 which is received in an upper one of a plurality of openings 20 in the display strip 13. The arrangement is such that the strip 13 is suspended vertically, with its principal plane oriented at right angles to the front face of the shelf 11. The two principal surfaces of the strip thus face up and down the shopping aisle, to be exposed to shoppers walking in either direction, along the aisle.

If desired, the suspension bracket may be welded or otherwise fixed to the upper end of the strip 13. It will be understood that any suitable suspension devise may be utilized to suspend the strip, as long as the strip hangs vertically with its principal surfaces facing up and down the shopping aisle.

In a particularly preferred embodiment of the invention, the display strip 13 is formed of a relatively stiff section of 18 gauge cold rolled steel, having a width of about 0.800 inch. The strip may be of any suitable length, for example 30 inches, depending on the specific application. In production, the strip may be formed from a continuous length of stock and cut to desired length as one of the final steps in the manufacturing process.

In accordance with the invention, the strip section 13 is formed with a series of longitudinally spaced product supporting tongue elements 21, 22, which are defined by cut-outs 23 and are integrally joined with the body of the strip at their bases 24. The cut-outs 23 are of generally inverted U-shaped configuration, forming a clearance space along the sides and top of the tongue elements 21, 22.

Figure 3:
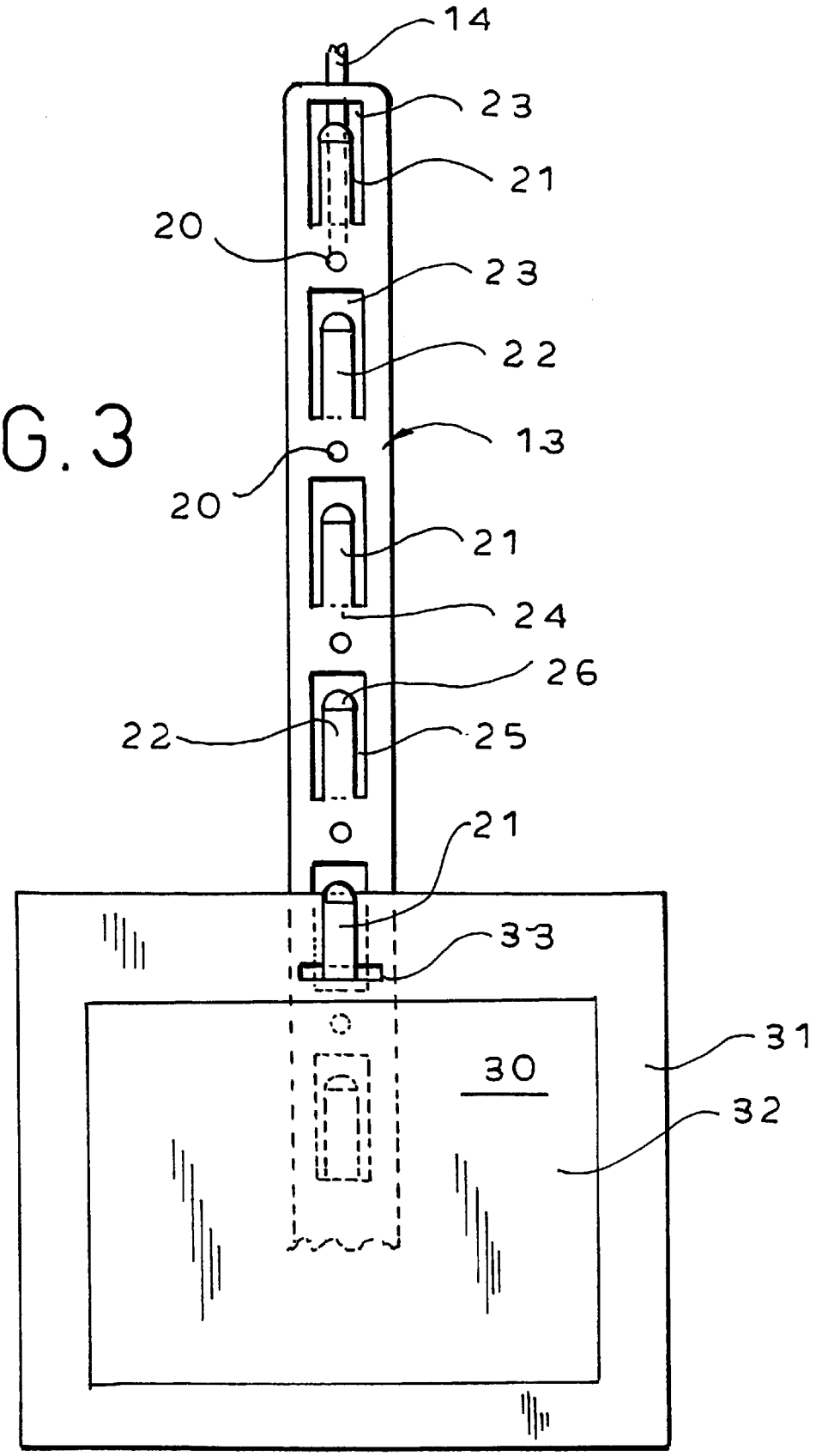
FIG. 3 is a fragmentary side elevational view of the display strip of FIG. 1.

As is evident if FIGS. 1 and 3, the respective tongues 21, 22 are displaced from the principal plane of the strip 13, alternately in opposite directions. In a specific preferred embodiment, the spacing between tongues 21 or 22 on the same side is about three inches and between successive tongues on opposite sides about 1.5 inches. The punching and stamping operations for creating the tongues are typically performed on a continuous basis, drawing strip from a large roll of strip stock and performing appropriate straightening operations, tongue forming operations and cut-off operations in a continuous sequence to create a strip section 13 of appropriate length. Production control is facilitated by providing openings 20 in the strip between each of the stamped-out tongues 21, 22. These openings enable the strip to be engaged and pulled in a step-by-step manner through the equipment performing the various straightening and punching operations. One of the upper most ones of the openings 20 may conveniently be used in he suspension of strip, as already described.

In the illustrated and preferred embodiment of the invention, the individual tongue elements 21, 22 may have a width of about 0.25 inch and a length of about 0.73 inch, disposed at an angle of about 35° to the principal plane of the strip. Desirably, the cut-outs 23 forms a slight clearance space around the tongues 21, 22. In the illustrated device, a clearance 25 along the sides of the tongue elements of about 0.063 is provided by the cut outs.

Figure 2:
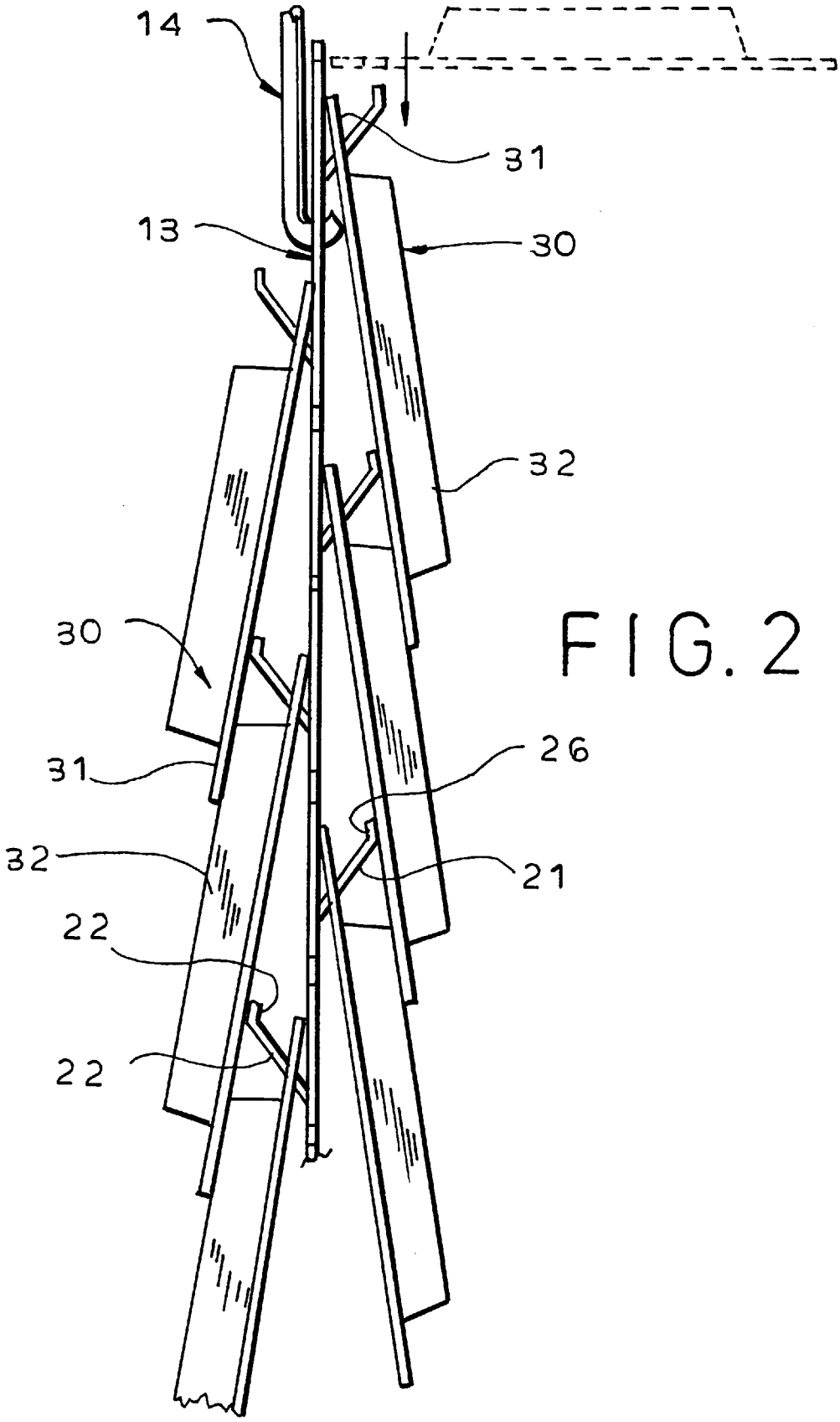
FIG. 2 is a fragmentary front elevational view of the display strip of FIG. 1, shown with product packages in display position thereon.

As is evident in the drawings, the upper ends 26 of the tongues 21, 22 are rounded off with a semi-circular contour. Additionally, the upper ends of the tongues are bent upward, at an angle to the lower portions of the tongues. As illustrated in FIG. 2, the upper ends 26 are preferably substantially parallel to the principal plane of the strip, so as to be generally vertical when the strip is suspended for display purposes. This been found to assist significantly in preventing accidental dislodgement of package suspended on the tongues. In the illustrated embodiment, upwardly bent tip portions 26 may comprise about ⅛th inch, which is approximately coextensive with the rounded portion of the tip.

As shown in FIGS. 2 and 3, product packages 30, typically comprising a card 31 and clear blister cover 32, are suspended on the tongues 21, 22, by means of slots 33 provided in the package cards 31. Packages are suspended on opposite sides of the strip 13, as is evident in FIG. 2, such that the package display is highly visible to customers walking in either direction in the shopping aisle.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. A product display comprising a display strip for mounting at a front of product display shelving, where said shelving has a front plane which defines in part a shopping aisle, said product display strip comprising, (a) an elongated, narrow metal strip having a principal plane, (b) means for suspending said strip at the front of the shelving, with the principal plane of said strip oriented generally at a right angle to said front plane and said shopping aisle, (c) a plurality of vertically spaced product support tongues, formed integrally from the material of said strip and extending outward and upwardly from the plane of said strip, (d) alternate ones of said product support tongues extending from opposite sides of the plane of said strip for support and display of product packages facing in opposite directions with respect to the shopping aisle, (e) lower portions of said tongues extending at an acute angle to the plane of said strip, and (f) upper extremities of said tongues being oriented at a shallower angle to the plane of said strip than said acute angle, and (g) a plurality of display packages suspended from a plurality of said product support tongues.

2. A product display according to claim 1, wherein said metal strip is stamped with a plurality of longitudinally spaced apart openings of generally inverted U-shaped configuration defining said tongues.

3. A product display according to claim 2, wherein secondary openings are formed between adjacent ones of said spaced apart openings.

4. A product display according to claim 3, wherein an upper one of said secondary openings can be utilized for suspending said strip.

5. A product display according to claim 1, wherein (a) said lower portions of said tongues extend at an angle of about 35° to the plane of said strip, and (b) said upper extremities of said tongues extend generally vertically upward.

6. A product display according to claim 5, wherein said upper extremities are of generally semicircular configuration.

* * * * *